US008578545B2

(12) United States Patent
Wolf et al.

(10) Patent No.: US 8,578,545 B2
(45) Date of Patent: Nov. 12, 2013

(54) CUSTOMIZABLE DISPOSABLE MOP

(75) Inventors: Boyd Wolf, Roswell, GA (US); Beth Hohl, Canton, GA (US); Elke Leuchten, Dusseldorf (DE)

(73) Assignee: Ecolab USA Inc., Saint Paul, MN (US)

( * ) Notice: Subject to any disclaimer, the term of this patent is extended or adjusted under 35 U.S.C. 154(b) by 43 days.

(21) Appl. No.: 13/404,893

(22) Filed: Feb. 24, 2012

(65) Prior Publication Data

US 2013/0219642 A1 Aug. 29, 2013

(51) Int. Cl.
*A47L 13/20* (2006.01)

(52) U.S. Cl.
USPC ..... 15/118; 15/228

(58) Field of Classification Search
USPC ..... 15/228, 118, 114, 115, 209.1, 223, 224
See application file for complete search history.

(56) References Cited

U.S. PATENT DOCUMENTS

| | | | | |
|---|---|---|---|---|
| 3,015,834 | A * | 1/1962 | Marrinson et al. | 15/228 |
| 4,349,933 | A * | 9/1982 | Thompson | 15/118 |
| 7,841,039 | B1 * | 11/2010 | Squire | 15/118 |
| 2005/0081888 | A1 * | 4/2005 | Pung et al. | 134/6 |
| 2007/0130713 | A1 * | 6/2007 | Chen et al. | 15/209.1 |
| 2007/0141299 | A1 * | 6/2007 | Hong | 428/97 |
| 2008/0028560 | A1 * | 2/2008 | Policicchio et al. | 15/229.3 |

* cited by examiner

*Primary Examiner* — Mark Spisich
*Assistant Examiner* — Andrew A Horton
(74) *Attorney, Agent, or Firm* — McKee, Voorhees & Sease, P.L.C.

(57) ABSTRACT

A customizable, disposable mop and method for customizing a disposable mop to have different floor contacting surface properties is disclosed. The mop (10) includes a floor contacting surface area (26) having a length and width and floor contacting surface properties. The outer layer (24) of the mop (10) has two or more partitions in covering relation over an inner layer (22). One or more of the outer layer partitions (28, 30, 32) is selectably separable along a seam from covering relation over the inner layer (22) or over two or more respective partitions (34, 36, 38) in the inner layer (22). The outer layer (24) and inner layer (22) partitions have a selectable mopping characteristic for customizing the properties of the floor contacting surface area (26) of the mop (10).

18 Claims, 8 Drawing Sheets

CUSTOMIZABLE DISPOSABLE MOP

BACKGROUND OF THE INVENTION

1. Field of the Invention

This invention relates generally to a disposable mop and more particularly to a disposable mop that includes the benefit of a floor contacting surface area that is customizable to exhibit desired mopping characteristics and properties.

2. Description of the Prior Art

With the evolution and development of the new mop materials, mops are now widely used for numerous wet and dry applications. Cheaper materials have also permitted the development and wide use of disposable mops. These mops are typically designed with characteristics and properties for a single type of use, and thus they are not well suited for other types of use.

It is therefore desirable to provide a disposable mop that is customizable to exhibit mopping characteristics and properties best suited for multiple types of use.

SUMMARY OF THE INVENTION

In one embodiment, the invention is a customizable disposable mop. The mop has a floor contacting surface area having a length and width and floor contacting surface properties. An outer layer of the mop has two or more partitions that are in covering relation over an inner layer of the mop. Each outer layer partition may be selectively separable along a seam so as to be removed from covering relation over the inner layer. The outer layer partitions have a selectable mopping characteristic for customizing the properties of the floor contacting surface area of the mop. In a preferred form, the selectable mopping characteristic of the floor contacting surface area includes at least a gliding property, a wetting property, a liquid dispersion property, and/or a scouring property.

In another embodiment, the invention is a customizable disposable mop. The mop includes a floor contacting surface area having a length and width and floor contacting surface properties. An outer layer of the mop has two or more lengthwise partitions in covering relation over respective partitions in an inner layer of the mop. Each outer layer partition is selectably separable along a seam so as to be removed from covering relation over each respective inner layer partition. Each of the layer partitions has a selectable mopping characteristic for customizing the properties of the floor contacting surface area of the mop for multiple uses. In a preferred form, the outer layer partitions have a different floor contacting surface property than the inner layer partitions.

In another embodiment, the invention is a method for customizing a disposable mop to have different floor contacting surface properties. A mop with a floor contacting surface area and an outer layer with two or more lengthwise partitions in covering relation over an inner layer is provided. Each layer or layer partition has a selectable mopping characteristic. One or more of the outer layer partitions is selectively removed from covering relation over the inner layer to customize the mopping characteristics of the floor contacting surface area. In a preferred form, the method also includes the step of identifying the outer layer partition to remove and/or to keep by a color code associated with a set of selectable mopping characteristics.

DETAILED DESCRIPTION OF THE PREFERRED EMBODIMENTS

Figure 1:
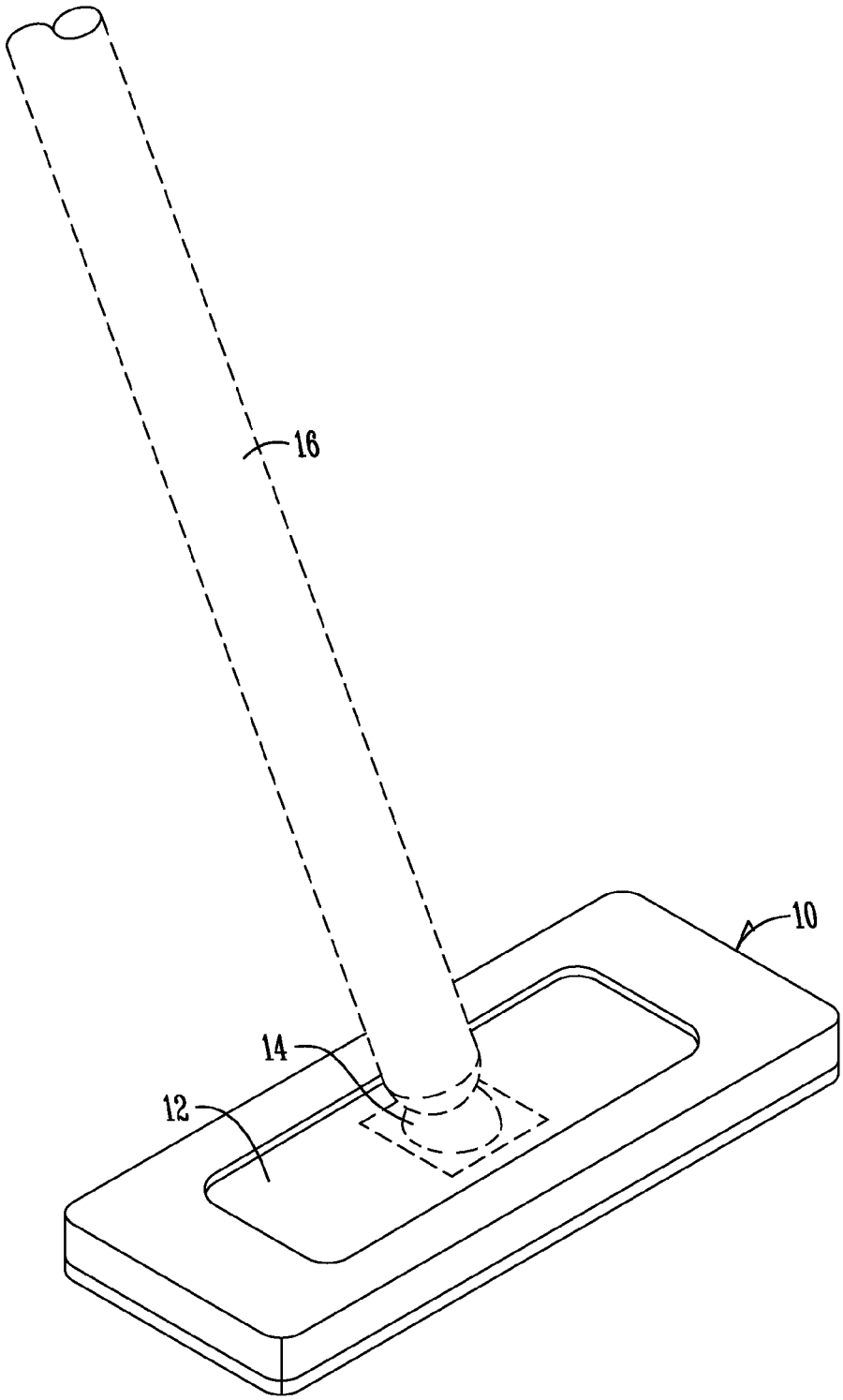
FIG. 1 is an isometric view of an exemplary embodiment of the mop of the present invention in combination with a mop handle and holder.
Figure 2:
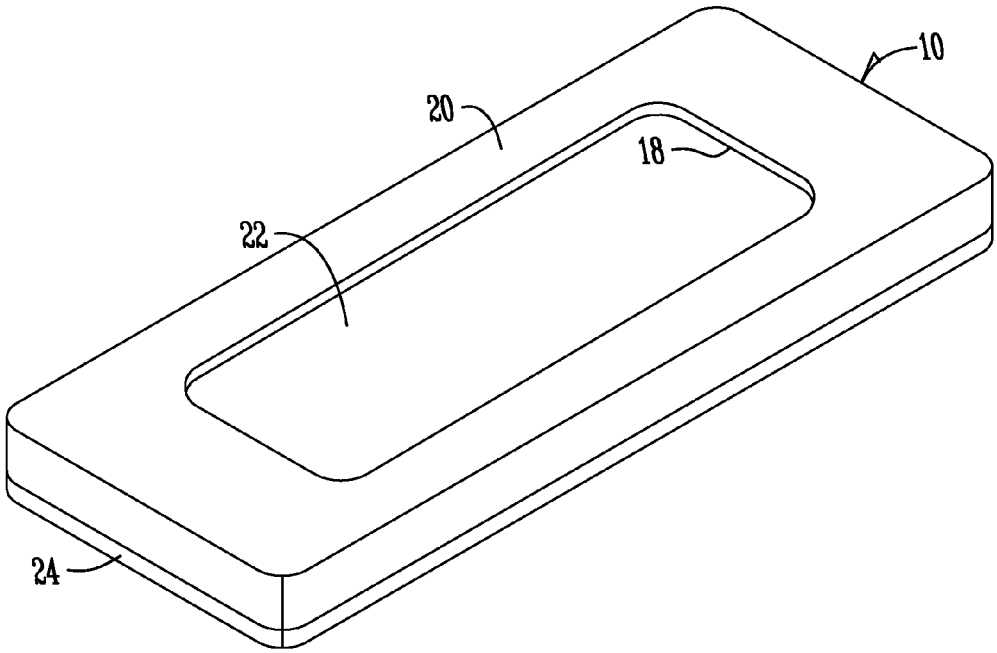
FIG. 2 is a topside isometric view of the mop shown in FIG. 1.

FIG. 1 illustrates in isometric view and exemplary embodiment of the mop 10 in combination with a commercially available mop handle 16 attached to a mop holder 12 by a mop head 14. The mop 10 is preferably disposable and therefore removably attachable to one or more commercial embodiments of a mop holder such as the mop holder 12 illustrated in FIG. 1. The mop 10 may include one or more features as best illustrated in FIG. 2 for removably attaching the mop 10 to one or more types of a commercial mop holder. These features may include, but are not limited to, a pocket 18 on opposing ends and/or edging 20 on the top side of the mop 10. These or other features allow the mop 10 to be quickly attached and removed to a commercial mop holder such as the mop holder 12 illustrated in FIG. 1. Such features as edging 20 and opposing pockets 18 are typically attached along the topside of the mop 10. One or more other features may be included on the top side of the mop 10 for allowing the mop 10 to be removably attached to a commercial mop holder. These features are not limited by the illustration of FIG. 2. For example, the top side of mop 10 may include one or more sleeves, slits, inserts, elastic members, hooks or other features that allow the mop 10 to be removably attached to a mop holder 12.

As illustrated in FIG. 2, the mop 10 includes an inner layer 22. In one aspect of the invention, one or more features for removably attaching the mop 10 to a mop holder 12, such as those discussed above, are attached to the inner layer 22 of the mop 10. The inner layer 22 generally comprises a base material of the mop 10. For example, in one embodiment of the invention, when the mop is attached to a mop holder such as the commercial mop holder 12 illustrated in FIG. 1, the top side of the inner layer 22 would rest against the bottom side of the mop holder 12. The present invention contemplates that other intervening layers may be included between the inner layer 22 and the bottom side of the mop holder 12 illustrated in FIG. 1 to facilitate further customization of the mopping properties and characteristics of the mop 10. The inner layer 22 is preferably covered by an outer layer 24. The material for both the inner layer 22 and the outer layer 24 is customizable so that the floor contacting surface area of the mop 10 exhibits one or more or a set of desired mopping characteristics or properties as further addressed below.

Figure 3A:
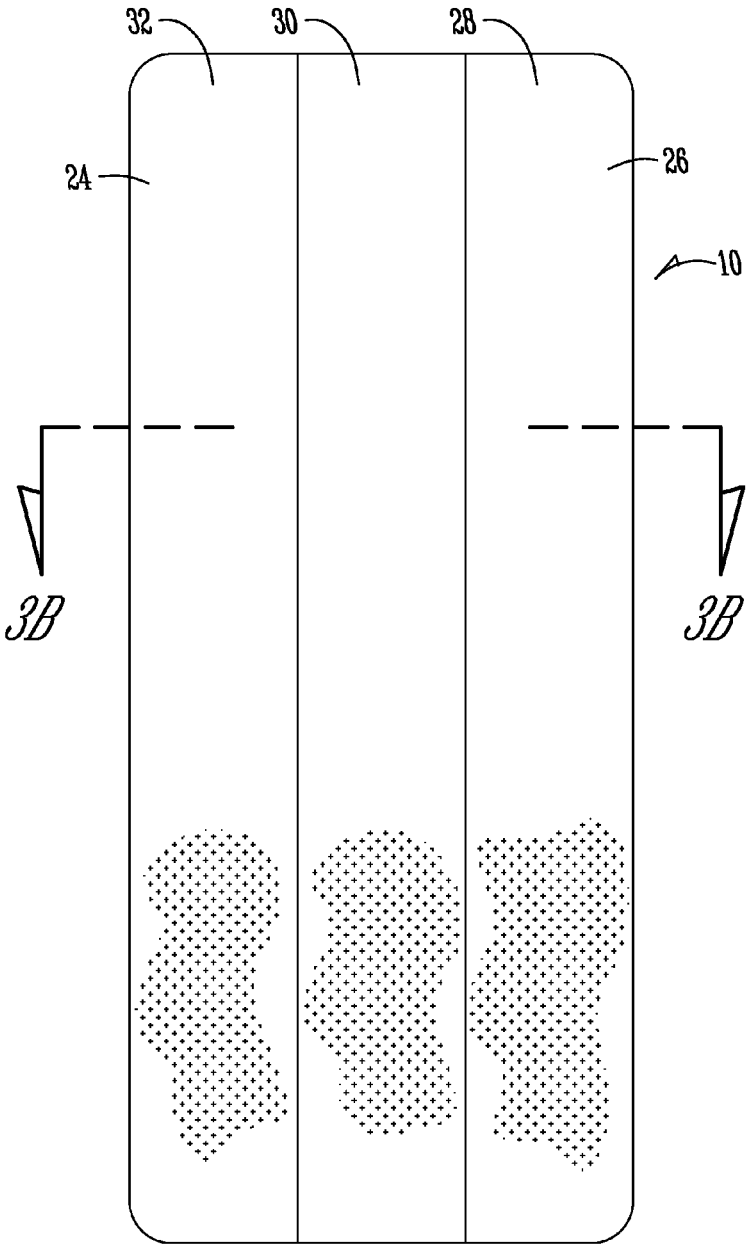
FIG. 3A is a bottom view of one exemplary embodiment of the mop shown in FIG. 2.
Figure 3B:
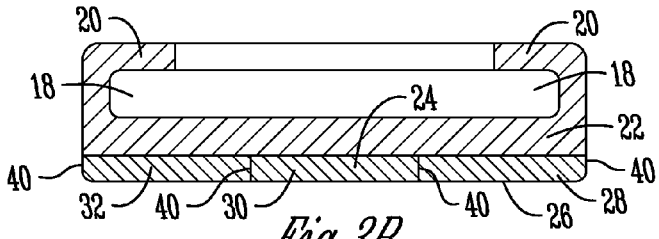
FIG. 3B is a sectional view taken along line 3B-3B of the mop shown in FIG. 3A.
Figure 3C:
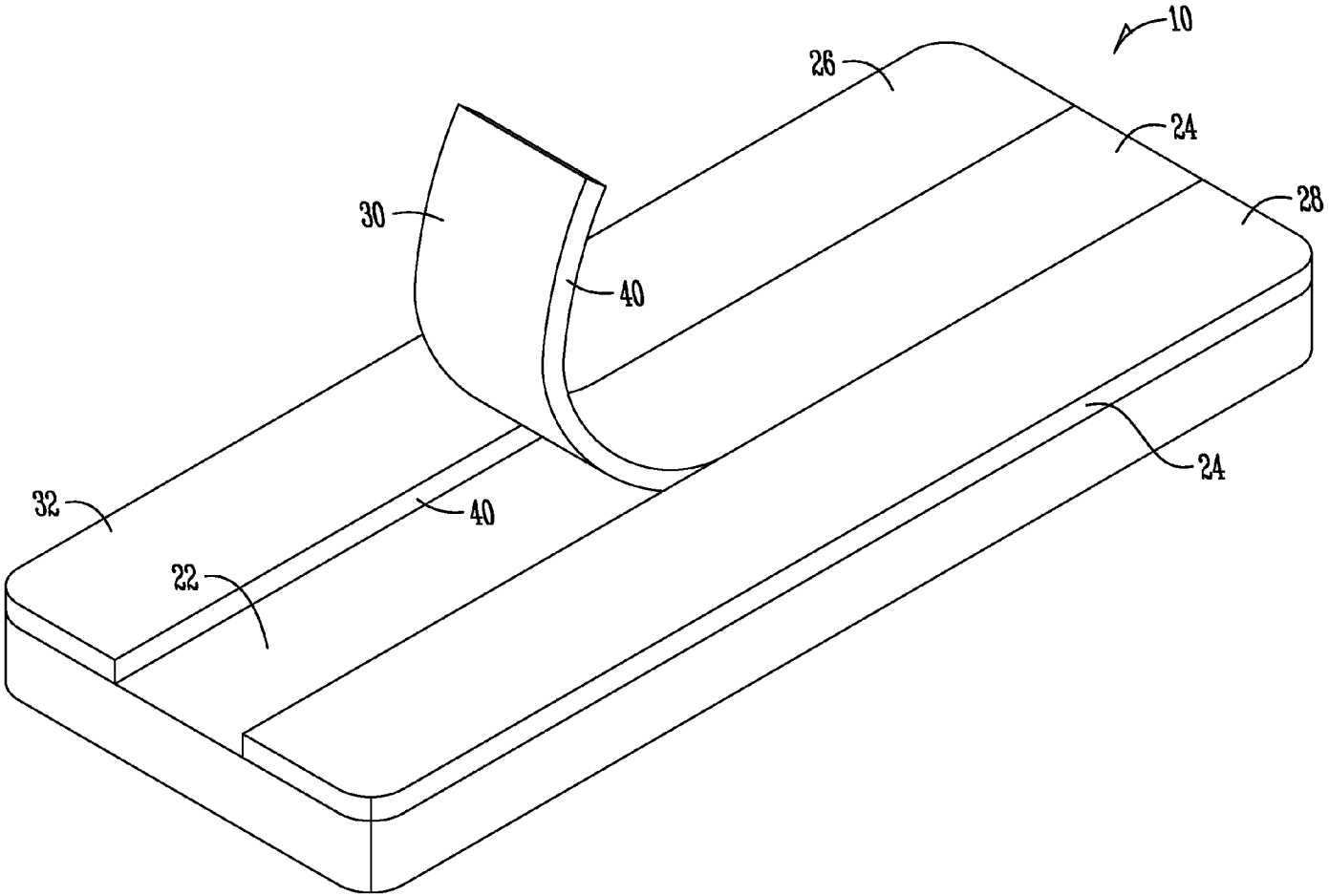
FIG. 3C is a bottom side isometric view of the mop shown in FIG. 3A.

FIGS. 3A-3C illustrate and exemplary embodiment of the mop 10 illustrated in FIG. 2. FIG. 3A illustrates the bottom side of the mop 10 illustrated in FIG. 2. The bottom side of the mop 10 presents a floor contacting surface area 26 defined by the length and width of the mop 10. In the embodiment illustrated in FIG. 3A, the entirety of the floor contacting surface area 26 is covered by the outer layer 24 of mop 10. The inner layer 22 of the floor contacting surface area 26 of mop 10 is covered entirely by the outer layer 24. In the embodiment illustrated in FIGS. 3A-3C, the inner layer 22 comprises synthetic fibers, such as a microfiber that includes single denier microfibers. The present invention contemplates that the inner layer 22 may also be comprised of various woven and non-woven materials ranging from synthetic to non-synthetic material types. In a preferred form of the invention, as shown in FIGS. 3A-3C, the inner layer material is a single denier microfiber material. The inner layer 22 is covered entirely by the outer layer 24. The outer layer 24, in one aspect of the invention, is partitioned into two or more outer layer partitions such as outer layer partition 28, 30 and 32. The present invention contemplates that the outer layer 24 may be partitioned into a desired number of outer layer partitions. By way of example, three partitions are illustrated in FIGS. 3A-3C. The outer layer partitions 28, 30 and 32 are removably secured to a portion of the inner layer 22, such as at an edge along the width or length of the inner layer 22, or an inner portion of the inner layer 22. The outer layer partitions 28, 30 and 32 are preferably configured lengthwise over the top of the inner layer 22 and along the length of the floor contacting surface area 26 of mop 10. The present invention also contemplates that the outer layer partitions 28, 30 and 32 or additional partitions, could be arranged to run along the width of the floor contacting surface area 26 of mop 10. Each outer layer partition 28, 30 and 32 are preferably attached to the inner layer 22 at seams 40, such as a tear seam, to allow one or more of the outer layer partitions 28, 30 or 32 to be selectively separated from the inner layer 22 as best illustrated in FIG. 3C. In another embodiment, the outer layer partitions 28, 30 and 32 may be removably connected to the inner layer 22 at their outer ends alone or together with seams 40. The outer layer partitions 28, 30 and 32 may be configured of the same material or different types of material. For example, the outer layer partition 28 may be one type of material, outer layer partition 30 another type of material, and outer layer partition 32 a different type of material than outer layer partition 28 and 30. The material of the outer layer partitions 28, 30 and 32 are selected to exhibit desired mopping characteristics and/or properties for customizing the floor contacting surface area 26 of mop 10. The outer layer partitions 28, 30 and 32 may also be of the same type of material. For example, the outer layer partitions 28, 30 or 32 may be a hydrophilic or hydrophobic material to customize the floor contacting surface areas affinity to liquid. For example, one or more of the outer layer partitions 28, 30 or 32 may be a hydrophilic type material that readily absorbs liquid into the inner layer 22. Conversely, one or more of the outer layer partitions 28, 30 or 32 may be a hydrophobic material that repels liquid away from the inner layer 22. In another aspect of the invention, the outer layer partitions 28, 30 or 32 may be a combination of hydrophilic and hydrophobic materials for customizing the mopping properties. One or more of the outer layer partitions 28, 30 or 32 may also be removed from covering relation over the inner layer 22 to control the degree of hydrophobicity or hydrophilicity of the floor contacting surface area 26 of the mop 10. The outer layer partitions 28, 30 and 32 may also be constructed of other types of non-woven or even woven materials. For example, the outer layer partitions 28, 30 and 32 may be constructed of a spunbonded, spunlaced, non-woven, and/or detergent impregnated material. Other contemplated materials include, for example, hydroentangled, thermobonded, needlepunched, and/or airlaid type materials. Thus, by keeping or removing one or more of the outer layer partitions 28, 30 or 32 a user is able to customize the mopping characteristics and/or properties of the floor contacting surface area 26 of mop 10. Furthermore, by removing or keeping one or more of the outer layer partitions 28, 30 or 32 a user is able to customize one or more of the mopping characteristics such as a gliding property of the floor contacting surface area 26, a wetting property of the floor contacting surface area 26, a liquid dispersion property of the floor contacting surface area 26, and/or a scouring property of the floor contacting surface area 26. These and/or other properties may be customized and/or are controlled by altering the type of materials used for the outer layer partitions 28, 30 and 32 and by keeping or removing one or more of the outer layer partitions 28, 30 or 32.

Figure 4A:
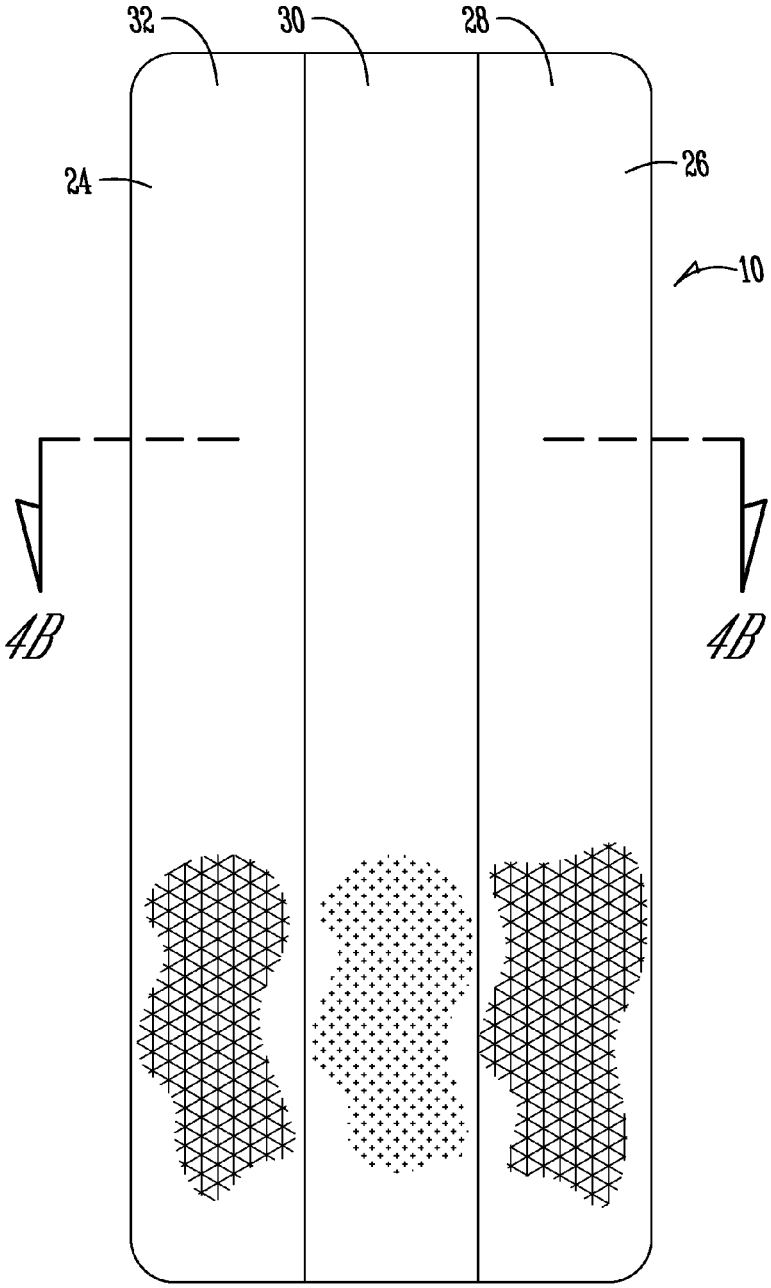
FIG. 4A is a bottom view of another exemplary embodiment of the mop shown in FIG. 2.
Figure 4B:
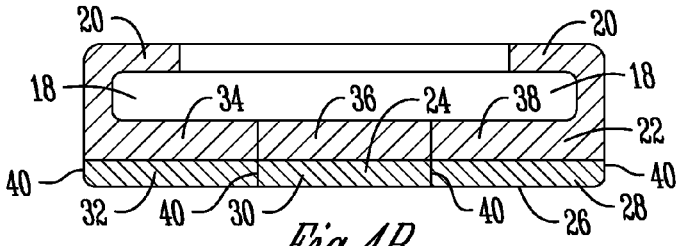
FIG. 4B is a sectional view taken along line 4B-4B of the mop shown in FIG. 4A.
Figure 4C:
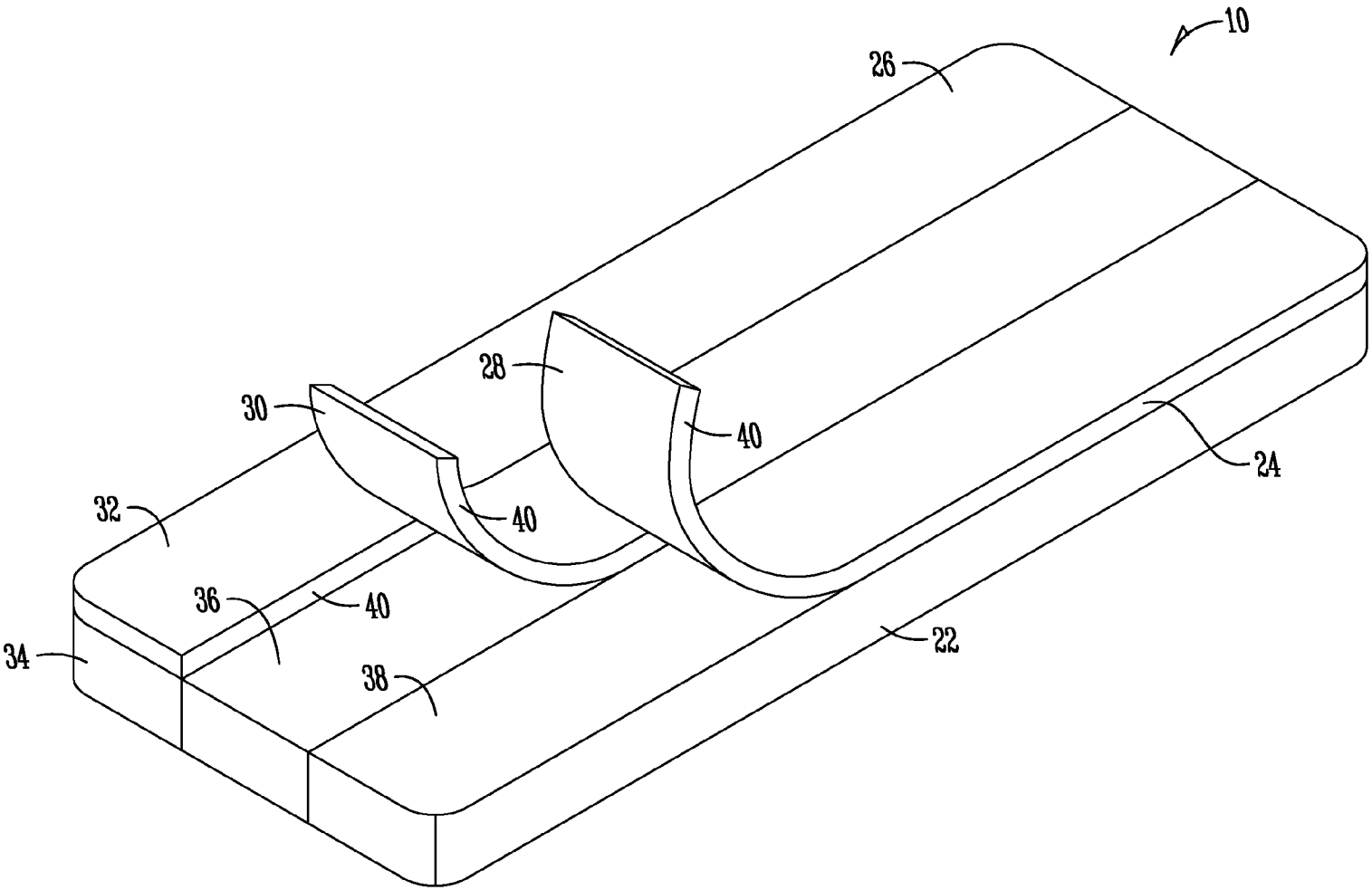
FIG. 4C is a bottom side isometric view of the mop shown in FIG. 4A.

In another aspect of the invention, the inner layer 22 may be partitioned similar to the outer layer partitions 28, 30 and 32. In this configuration, the outer layer partitions 28, 30 and 32 are configured to cover the respective inner layer partitions 34, 36 and 38 as best illustrated in FIGS. 4A-4C. In this embodiment, the inner layer 22 and outer layer 24 are partitioned, and the outer layer partitions 28, 30 and 32 and the inner layer partitions 34, 36 and 38 may be configured of numerous types of materials to provide customized properties for the floor contacting surface area 26 of mop 10. For example, the inner layer 22 may include two or more inner layer partitions. By way of example, FIGS. 4A-4C illustrate three inner layer partitions, namely inner layer partitions 34, 36 and 38. The present invention contemplates that the number of partitions can be changed according to the desired number of materials used to construct the inner layer 22. The number of inner layer partitions and materials used may also be configured to correspond with the number of outer layer partitions and materials used. For example, in the instance where two different materials are used to construct the inner layer partitions, two different materials may be used to construct the outer layer partitions. In the exemplary illustration shown in FIGS. 4A-4C, the inner layer 22 includes three inner layer partitions 34, 36 and 38. The inner layer partitions 34, 36 and 38 may be a microfiber material as discussed above, or another material type such as cotton, rayon and/or a detergent impregnated material. Other contemplated materials include, for example, polyester, polyamid, polyacryl, and/or polypropylene. In one embodiment, the inner layer partitions 34 and 38 may be a microfiber material such as a single or multi-denier microfiber and the inner layer partition 36 may be a scouring type material. As previously discussed, the outer layer partitions 28, 30 and 32 may also be of varying material types to control and customize the floor contacting surface area 26 of mop 10. Either by keeping or removing one or more of the outer layer partitions 28, 30 and 32 the mopping characteristics and properties of the floor contacting surface area 26 are configurable for multiple uses. For example, in the instance where some scouring affect and a decrease in the gliding properties of the floor contacting surface area 26 is needed, an outer layer partition such as outer layer partition 30 may be separated from the inner layer 22 to expose a scouring type inner layer material 36, and an outer layer hydrophobic partition 28 may be separated from the inner layer 22 to expose a highly absorptive layer 38 that decreases the gliding properties of the floor contacting surface area 26 of the mop 10. In the case where the use of the mop 10 does not require the scouring surface of the inner layer partition 36 or less gliding properties, the outer layer partitions 28 and 30 may be left attached to the floor contacting surface area 26 of the mop 10. By configuring the material types for the inner layer partitions 34, 36 and 38 and the material types used for the outer layer partitions 28, 30 and 32, and by keeping or separating one or more of the outer layer partitions 28, 30 or 32 from the floor contacting surface area 26 of mop 10 a single mop may be customized or configured for multiple uses.

Figure 5A:
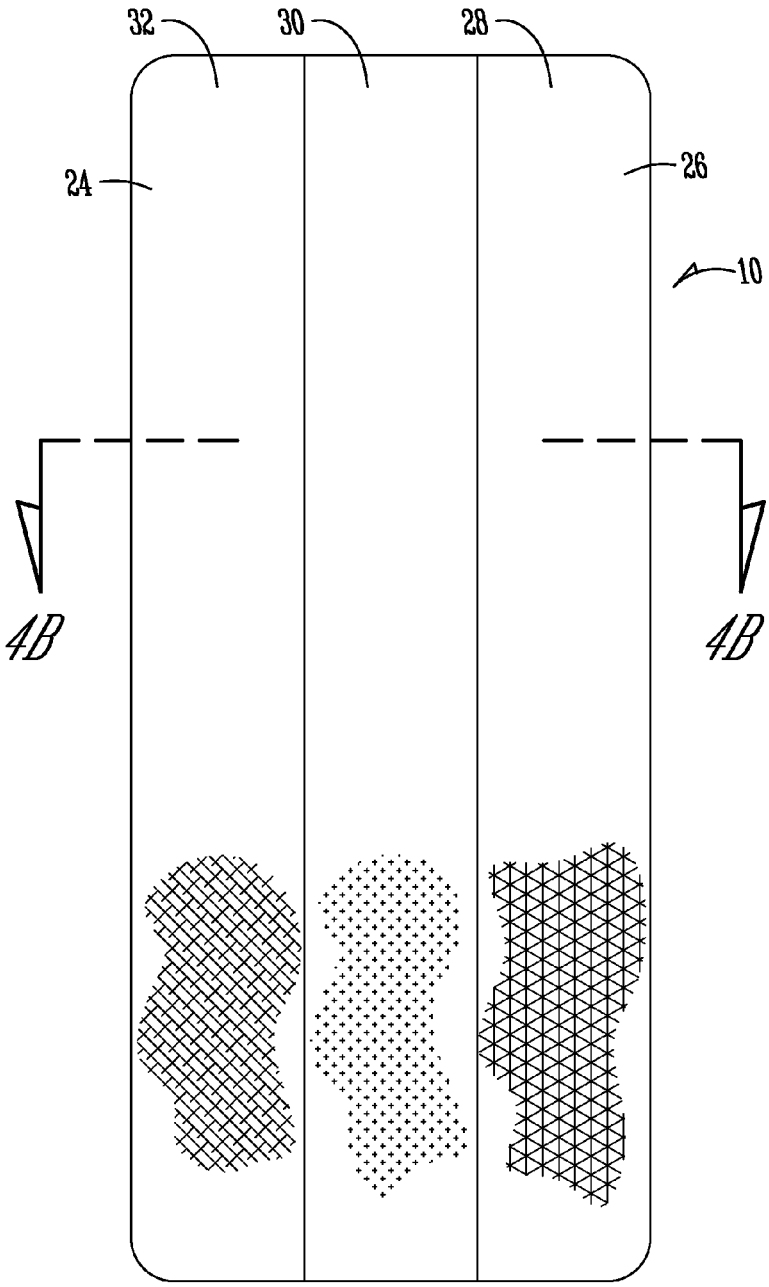
FIG. 5A is a bottom view of another exemplary embodiment of the mop shown in FIG. 2.
Figure 5B:
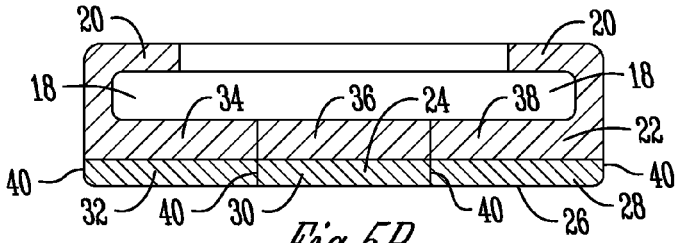
FIG. 5B is a sectional view taken along line 5B-5B of the mop shown in FIG. 5A.
Figure 5C:
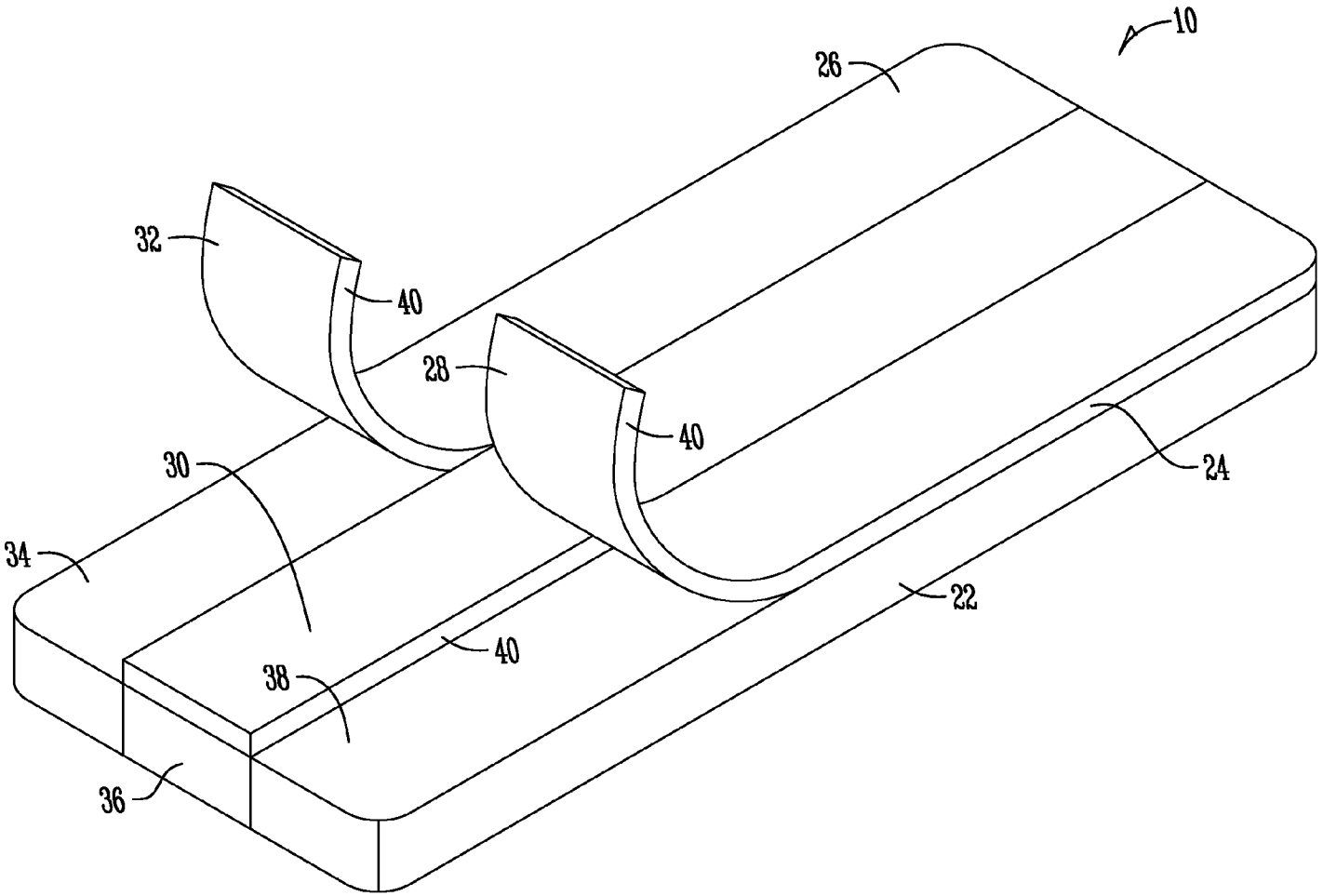
FIG. 5C is a bottom side isometric view of the mop shown in FIG. 5A.

FIGS. 5A-5C further illustrate the customizability of mop 10. Similar to mop 10 illustrated in FIGS. 4A-4C, the inner layer 22 is partitioned into several inner layer partitions 34, 36 and 38. As previously discussed, the number of partitions can be adjusted according to the types of materials desired to be included in the inner layer 22 of mop 10. However, by way of example, three inner layer partitions are shown. The type of material used for each inner layer partition 34, 36 and 38 may be configured to achieve or obtain a set of desired mopping properties or characteristics that are best suited for a specific task. For example, and as shown, the inner layer partition 34 may be one material type that is different from the inner layer partition 36 and inner layer partition 38. This may include for example the inner layer partition 34 material being more hydrophilic than the material used for the inner layer partition 38. The material used for the inner layer partition 36 may be a material that is more hydrophilic or hydrophobic than the other inner layer partition materials or that includes scouring properties. Similarly, as discussed above, the outer layer partitions 28, 30 and 32 may be configured of the same material or different material. Furthermore, by keeping or removing one or more of the outer layer partitions 28, 30 or 32 and thereby exposing or not exposing the inner layer partitions 34, 36 or 38, the floor contacting surface area 26 of mop 10 is customizable to exhibit a set of desired mopping characteristics or properties suitable for any number of task. This may include, for example, selectively removing outer layer partitions 28 and 32 from the floor contacting surface area 26 of mop 10 as shown in FIG. 5C to customize the properties of the floor contacting surface area 26 of mop 10 to perform a specific task. In this instance, the floor contacting surface area 26 of mop 10 exhibits the properties of the inner layer partitions 34 and 38 along with the couple properties of inner layer partition 36 and outer layer partition 30.

The above specification, examples, and data provide a complete description of the manufacturing use of the composition of the invention. Since many embodiments of the invention can be made without departing from the spirit and scope of the invention, the invention resides in the claims hereinafter appended.

What is claimed is:

1. A customizable, disposable mop comprising:

a floor contacting surface area having a length and width and floor contacting surface properties;

an outer layer having two or more lengthwise partitions in covering relation over respective lengthwise partitions in an inner layer, at least one partition of the inner layer having a mopping characteristic different from that of the other inner layer partitions, each outer layer partition selectably separable along a seam from covering relation over each respective inner layer partition; and each of the layer partitions having a selectable mopping characteristic for customizing the properties of the floor contacting surface area.

2. The mop of claim 1 wherein the partitions of the inner layer comprise two or more different fiber materials.

3. The mop of claim 2 wherein the one of the inner layer partitions is a single or multi-denier microfiber material.

4. The mop of claim 1 wherein the partitions of the outer layer comprise two or more different fiber materials.

5. The mop of claim 4 wherein at least one of the partitions of the outer layer is a non-woven hydrophilic material.

6. The mop of claim 4 wherein at least one of the partitions of the outer layer is a non-woven hydrophobic material.

7. The mop of claim 1 wherein the selectable mopping characteristic includes one of:

a. a gliding property of the floor contacting surface area;

b. a wetting property of the floor contacting surface area;

c. a liquid dispersion property of the floor contact surface area;

d. a scouring property of the floor contacting surface area;

e. a detergent composition property for the floor contacting surface area.

8. The mop of claim 1 wherein the outer layer partitions have a different floor contacting surface property than the inner layer partitions.

9. A method for customizing a disposable mop to have different floor contacting surface properties, comprising:

providing a mop with a floor contacting surface area and an outer layer with two or more lengthwise partitions in covering relation over respective lengthwise partitions of an inner layer, at least one partition of the inner layer having a mopping characteristic different from that of the other inner layer partitions, wherein each layer or layer partition has a selectable mopping characteristic; and selectively removing one or more outer layer partitions from covering relation over the inner layer to customize the mopping characteristics of the floor contacting surface area wherein the outer layer partitions are in covering relation over two or more respective partitions in the inner layer.

10. The mop of claim 9 wherein the partitions of the inner layer comprise two or more different fiber materials.

11. The mop of claim 9 wherein the one of the inner layer partitions is a single or multi-denier microfiber material.

12. The mop of claim 9 wherein the partitions of the outer layer comprise two or more different fiber materials.

13. The mop of claim 9 wherein at least one of the partitions of the outer layer is a non-woven hydrophilic material.

14. The mop of claim 9 wherein at least one of the partitions of the outer layer is a non-woven hydrophobic material.

15. The mop of claim 9 wherein the selectable mopping characteristic includes one of:

a. a gliding property of the floor contacting surface area;

b. a wetting property of the floor contacting surface area;

c. a liquid dispersion property of the floor contact surface area;

d. a scouring property of the floor contacting surface area;

e. a detergent composition property for the floor contacting surface area.

16. The mop of claim 9 wherein the outer layer partitions have a different floor contacting surface property than the inner layer partitions.

17. A customizable, disposable mop comprising:

a floor contacting surface area having a length and width and floor contacting surface properties;

an outer layer having two or more lengthwise partitions in covering relation over respective lengthwise partitions in an inner layer, the partitions of the inner layer being attached to a respective longitudinal edge of an adjacent inner layer partition, each outer layer partition selectably separable along a seam from covering relation over each respective inner layer partition; and each of the layer partitions having a selectable mopping characteristic for customizing the properties of the floor contacting surface area.

18. A method for customizing a disposable mop to have different floor contacting surface properties, comprising:

providing a mop with a floor contacting surface area and an outer layer with two or more lengthwise partitions in covering relation over respective lengthwise partitions of an inner layer, the partitions of the inner layer being attached to a respective longitudinal edge of an adjacent inner layer partition, wherein each layer or layer partition has a selectable mopping characteristic; and selectively removing one or more outer layer partitions from covering relation over the inner layer to customize the mopping characteristics of the floor contacting surface area wherein the outer layer partitions are in covering relation over two or more respective partitions in the inner layer.

* * * * *